US012383038B2

(12) United States Patent
Lapize et al.

(10) Patent No.: US 12,383,038 B2
(45) Date of Patent: Aug. 12, 2025

(54) PROCESS FOR TREATING HAIR FIBRES

(71) Applicant: L'OREAL, Paris (FR)

(72) Inventors: Sandy Lapize, Clichy (FR); Stefania Nuzzo, Clichy (FR)

(73) Assignee: L'OREAL, Paris (FR)

( * ) Notice: Subject to any disclaimer, the term of this patent is extended or adjusted under 35 U.S.C. 154(b) by 262 days.

(21) Appl. No.: 16/954,842

(22) PCT Filed: Dec. 12, 2018

(86) PCT No.: PCT/EP2018/084637
§ 371 (c)(1),
(2) Date: Jun. 17, 2020

(87) PCT Pub. No.: WO2019/121267
PCT Pub. Date: Jun. 27, 2019

(65) Prior Publication Data

US 2021/0085051 A1 Mar. 25, 2021

(30) Foreign Application Priority Data

Dec. 22, 2017 (FR) ..... 1763172

(51) Int. Cl.
*A45D 7/02* (2006.01)
*A45D 7/06* (2006.01)
(Continued)

(52) U.S. Cl.
CPC ..... *A45D 7/02* (2013.01); *A45D 7/06* (2013.01); *A45D 24/22* (2013.01); *A45D 2001/008* (2013.01)

(58) Field of Classification Search
CPC ..... A45D 2001/008; A45D 1/06; A45D 1/08; A45D 1/18; A45D 7/00; A45D 7/02; A45D 7/06; A45D 24/22; A45D 24/44
(Continued)

(56) References Cited

U.S. PATENT DOCUMENTS

2004/0000319 A1* 1/2004 Carballada ..... A45D 1/04 132/224
2004/0045570 A1 3/2004 Yao
(Continued)

FOREIGN PATENT DOCUMENTS

CN 106388208 2/2017
EP 0 659 393 A1 6/1995
(Continued)

OTHER PUBLICATIONS

International Search Report issued Feb. 21, 2019 in PCT/EP2018/084637 filed Dec. 12, 2018.
(Continued)

*Primary Examiner* — Cris L. Rodriguez
*Assistant Examiner* — Luis Ruiz Martin
(74) *Attorney, Agent, or Firm* — Oblon, McClelland, Maier & Neustadt, L.L.P.

(57) ABSTRACT

A process for treating hair fibres, including: (i) combing said fibres, (ii) applying vapour to said fibres, the flow rate of vapour applied being less than 1 g/min, the application of vapour being made in a confined space, and (iii) hair shaping, by heat treatment without vapour, of the hair fibres by conduction and/or by radiation. Steps (ii) and (iii) being made separately over a same zone of the hair fibres.

14 Claims, 1 Drawing Sheet

(51) Int. Cl.
*A45D 24/22* (2006.01)
*A45D 1/00* (2006.01)

(58) Field of Classification Search
USPC ..... 132/206
See application file for complete search history.

(56) References Cited

U.S. PATENT DOCUMENTS

| | | | | |
|---|---|---|---|---|
| 2010/0307528 | A1* | 12/2010 | Restle | A45D 7/02 132/211 |
| 2015/0289622 | A1* | 10/2015 | Fereyre | A45D 19/16 132/211 |
| 2015/0327650 | A1* | 11/2015 | Fereyre | A45D 1/08 132/269 |
| 2017/0079400 | A1 | 3/2017 | Fereyre | |
| 2017/0112254 | A1 | 4/2017 | Fereyre | |
| 2018/0153294 | A1* | 6/2018 | Thomas | A45D 2/001 |
| 2018/0213909 | A1 | 8/2018 | Fereyre et al. | |
| 2018/0213910 | A1 | 8/2018 | Fereyre et al. | |
| 2019/0110569 | A1* | 4/2019 | Messager | A45D 34/00 |
| 2020/0275753 | A1* | 9/2020 | Debauge | A45D 1/06 |

FOREIGN PATENT DOCUMENTS

| | | | | |
|---|---|---|---|---|
| EP | 0 659 395 | A1 | 6/1995 | |
| EP | 0 659 396 | A1 | 6/1995 | |
| EP | 0 659 397 | A1 | 6/1995 | |
| EP | 1 396 207 | A1 | 3/2004 | |
| EP | 1 515 628 | A1 | 3/2005 | |
| EP | 1 515 629 | A1 | 3/2005 | |
| EP | 1 516 554 | A1 | 3/2005 | |
| EP | 2 236 053 | A1 | 10/2010 | |
| FR | 2873578 | A1 * | 2/2006 | A61K 8/85 |
| FR | 2892629 | | 4/2007 | |
| FR | 2 967 017 | A1 | 5/2012 | |
| FR | 3015875 | A1 * | 7/2015 | A45D 1/04 |
| FR | 3 020 930 | A1 | 11/2015 | |
| JP | 10-94417 | A | 4/1998 | |
| JP | 2000-157322 | A | 6/2000 | |
| JP | 2004-208921 | A | 7/2004 | |
| JP | 2017-515590 | A | 6/2017 | |
| KR | 10-2010-0063778 | A | 6/2010 | |
| WO | WO 2004/002262 | A1 | 1/2004 | |
| WO | WO 2004/002263 | A1 | 1/2004 | |
| WO | WO 2014/064660 | A1 | 5/2014 | |
| WO | WO-2014167218 | A1 * | 10/2014 | A45D 1/04 |
| WO | WO 2015/173507 | A1 | 11/2015 | |
| WO | WO 2017/017111 | | 2/2017 | |
| WO | WO 2017/017158 | A1 | 2/2017 | |

OTHER PUBLICATIONS

French Preliminary Search Report issued Sep. 10, 2018 in Patent Application No. 1763172 filed Dec. 22, 2017.
Korean Office Action issued Sep. 7, 2021 in Korean Patent Application No. 10-2020-7017431 (with English translation), 10 pages.
Japanese Office Action issued Sep. 27, 2021 in Japanese Patent Application No. 2020-534556 (with English translation), 15 pages.
Chinese Office Action issued Aug. 23, 2022, in Chinese Patent Application No. 201880083248.5 (with English translation), 16 pgs.
Japanese Office Action issued Jun. 19, 2023, in Japanese Patent Application No. 2020-534556 (with English translation), 15 pgs.

* cited by examiner

PROCESS FOR TREATING HAIR FIBRES

TECHNICAL FIELD OF THE INVENTION

The present invention relates to a process for treating hair fibres, and more particularly (human) hair.

PRIOR ART

It is known to smooth hair fibres with smoothing tongs. These tongs make it possible to smooth hair fibres at high temperature without pulling on the hair fibres, in contrast to blow drying. However, in order to obtain a good smooth appearance, it is necessary to carry out several passes of the tongs, which considerably extends the treatment time. Furthermore, the repeated application of the smoothing tongs can sometimes cause damage to the hair fibres due to the temperature to which said fibres are exposed.

It is known to use vapour for treating hair fibres, for example combined with a treatment with heating plates, the vapour being sprayed or diffused onto the hair. Such a process may be carried out with an apparatus for treating hair fibres and/or be combined with different cosmetic hair treatments. Mention may be made, by way of example, of documents EP 659 395, EP 659 393, EP 659 396, EP 659 397, US 2004/0000319, US 2004/0045570, JP 2000157322, EP1396207, EP1515628, EP1515629, EP1516554, FR 2967017 and WO 2004/002262.

International application WO 2014/064660 describes a device which makes it possible to apply a cosmetic product to the hair, to expose the latter to vapour, to subject said hair to heat treatment and to comb it.

Furthermore, a process for treating hair fibres, comprising combing the hair fibres, applying a composition to the hair fibres, treating the hair fibres by applying vapour and heat-treating the hair fibres by conduction and/or radiation using heating plates is known from international application WO 2017017158.

Finally, a hairstyling apparatus comprising a portable treatment unit having two arms configured to form tongs, provided with two heating contact surfaces defined by plates arranged facing one another, which make it possible to concomitantly grasp a lock of hair, is known from publications FR3020930 and WO 2015/173507. This treatment unit comprises vapour diffusion means configured to diffuse vapour from a first of the two surfaces toward the second. One of the arms comprises a comb arranged downstream or upstream of one of the contact surfaces. The treatment process carried out using this apparatus thus consists, for a lock of hair, in carrying out the following process: combing, grasping the lock between the contact surfaces and heat treatment, applying vapour then heat treatment of the lock between the contact surfaces.

However, the processes of the prior art are not entirely satisfactory in terms of the results obtained on the hair fibres, especially in terms of volume and manageability.

There is therefore a need to develop a novel process for treating hair fibres that is easy and quick to carry out and that respects the hair fibre, while obtaining good cosmetic results.

There is also a need for a high-performance process for effectively smoothing hair fibres.

SUMMARY OF THE INVENTION

The invention aims to meet all or some of these needs, and does so by virtue of a process for treating hair fibres, comprising:

(i) combing said fibres, (ii) applying vapour to said fibres, the flow rate of vapour applied being strictly less than 1 g/min, (iii) hair shaping, by heat treatment without vapour, of said fibres by conduction and/or by radiation, especially by contact with at least one heating plate, steps (ii) and (iii) being separate.

According to the invention, the steps of applying vapour to the hair fibres and of hair shaping, by heat treatment without vapour, of the hair fibres, are separate; that is to say that they do not take place at the same time over the same zone of the hair fibres. On the other hand, the same zone of hair fibres may be subjected to both steps, as long as they are not simultaneous.

The term "hair fibres" encompasses human keratin fibres and also synthetic fibres known as "extensions" which are sometimes added to an individual's natural head of hair by various means, especially by adhesive bonding, in order for example to modify the appearance of an individual's natural head of hair.

The vapour is preferably steam, with or without additives. The additives are preferably selected from solvents and oils. The vapour preferably consists solely of water.

Step (ii) of applying the vapour to the hair fibres is preferably carried out in a confined space. This confined space is thus provided for the accumulation of vapour in this space. The vapour flow rate is thus reduced, less than 1 g/min, for satisfactory humidification of the hair fibres without them being too wet.

Step (iii) of heat treatment without vapour may be carried out by bringing the hair fibres into contact with at least one hot surface, especially two hot surfaces, the surface(s) being formed especially of one or more heating plates which may also apply tension to the hair fibres when the apparatus is moved along the treated lock, thereby making it possible to smooth, style or disentangle them.

Step (iii), aside from the heat treatment without vapour of the hair fibres, may comprise the grasping of said hair fibres, especially between plates. In this case, according to the invention, there is no grasping of the zone of the hair fibres concerned by step (ii) of applying vapour. In other words, the vapour is thus directed onto a zone of the hair fibres which is not grasped between the plates. As a result, and also as a result of the fact that the hair fibres are combed in step (i), before step (ii) of applying vapour, the hair fibres are better impregnated with vapour. The application of a reduced flow rate is therefore sufficient to impregnate the fibres with vapour.

It should be noted that the application of vapour at a reduced flow rate of less than 1 g/min may especially make it possible to limit the electricity consumption of the apparatus applying the vapour and to increase the autonomy of the tank of water (with or without additives) of this apparatus.

The heat treatment in step (iii) may be carried out at a temperature greater than or equal to 90° C., preferably greater than or equal to 120° C., more preferably greater than or equal to 140° C., even more preferably greater than or equal to 170° C., and/or less than or equal to 230° C., preferably less than or equal to 220° C., more preferably less than or equal to 210° C. The heat treatment in step (iii) is thus advantageously carried out at a temperature ranging from 90° C. to 230° C., preferably between 120° and 210° C., more preferentially from 170° C. to 210° C.

Preferably, at least steps (ii) and (iii) are carried out within the same apparatus for treating the head of hair. Said apparatus may comprise at least two plates, at least one of which is heating, arranged facing one another, between which the hair fibres pass in order to carry out step (iii). This apparatus advantageously also comprises, for carrying out step (ii), at least one vapour outlet acting on a zone of the hair fibres other than that included between the plates at a given moment. The apparatus preferably has a groove facing said at least one vapour outlet, said at least one vapour outlet and this groove being offset relative to the plates.

Said at least one vapour outlet may be formed by at least one vapour outlet nozzle, especially a row of nozzles. Said at least one vapour outlet is preferably offset upstream of the plates on the apparatus relative to the direction in which the hair fibres move in the apparatus. Thus, a given zone of the hair fibres is firstly subjected to exposure to the vapour before passing between the plates, when the apparatus is moved along the lock to be treated.

The apparatus for treating the head of hair is thus configured to successively carry out at least steps (ii) and (iii) on the same lock of hair fibres.

In step (ii), the hair fibres are thus made to pass between said at least one vapour outlet and the abovementioned groove.

The abovementioned groove makes it possible to clearly separate the zones of vapour application and of heat treatment without vapour by the plates, which makes it possible to clearly separate steps (ii) and (iii).

The groove makes it possible to create an at least partially confined space for receiving the vapour, enabling the accumulation thereof. This may make it possible to increase the effectiveness of the vapour application while only requiring a reduced flow rate.

The groove does not comprise its own heating system, and is not associated with such a system. In other words, the surface delimiting the groove is only heated by the directed vapour on contact therewith. In particular, it does not receive any notable heat flow from the heating plates, since it is produced outside the latter.

Step (i) of combing may be carried out within the same apparatus for treating the head of hair, this apparatus also being able to comprise a comb, preferably arranged upstream of said at least one vapour outlet. In this case, the comb may contribute, via the barrier formed by the tines it comprises, to the partial confinement of the vapour in the vapour application zone around said at least one vapour outlet.

As a variant, the comb may not be present on the apparatus which applies the vapour, the combing step thus being carried out independently, for example before carrying out steps (ii) and (iii) using this apparatus.

The flow rate of vapour applied preferably ranges from 0.7 g/min to 0.9 g/min, better still from 0.75 g/min to 0.85 g/min.

The treatment steps are preferably carried out in the following order: (i), (ii), then (iii).

At least steps (ii) and (iii) may be carried out in a single pass per lock of hair fibres.

The process may comprise an additional step of applying at least one cosmetic composition, especially a cosmetic care composition, to the hair fibres. In this case, the additional step may take place after step (i) of combing the hair fibres and after step (ii) of applying vapour to the hair fibres. Also in this case, it may be carried out within the apparatus for treating hair fibres.

As a variant, this additional step, when it takes place, may be carried out before step (i) of combing and/or outside of the apparatus for treating the head of hair. In this case, the process does not comprise an additional step of applying at least one cosmetic composition to the hair fibres between step (i) and step (ii), step (i) of combing being immediately followed by step (ii) of applying vapour. Also in this case, an apparatus carrying out steps (i) and (ii) does not contain any cartridge of cosmetic composition, aside from a possible tank for water, with or without additives, for applying vapour in step (ii).

The process according to the invention does not provide grasping of the hair fibres between plates before and during the application of vapour. Therefore, before step (ii) for applying vapour and/or step (iii) for heat treatment without vapour, there is no friction against the plates. Thus, when the additional step of applying at least one cosmetic composition to the hair fibres takes place, the hair fibres retain, during the application of vapour, a greater amount of composition on the hair fibres than if there had been friction between plates beforehand.

In one variant, the process may not comprise a step of applying at least one cosmetic composition to the hair fibres.

Preferably, all the successive steps are carried out with a period between them of less than or equal to 5 min for the same lock of hair fibres, better still less than or equal to 1 min, even better still less than or equal to 30 s, preferentially less than or equal to 15 s.

More preferably, the process comprises a single combing step, making it possible to simplify the process without the efficiency of the treatment being affected thereby.

When the process comprises the additional step of applying at least one cosmetic composition, the latter preferably has a viscosity of less than or equal to 400 cps, better still less than or equal to 200 cps at 22° C. and 1013.25 hPa, and at a shear rate of 1 $s^{-1}$. Said at least one composition may be aqueous or anhydrous. Said at least one cosmetic composition may comprise at least one ingredient chosen from solvents, surfactants, thickeners, preservatives, fragrances, dye precursors, direct dyes, silicone or non-silicone and fixing or non-fixing polymers, fatty substances, in particular mineral, vegetable or synthetic oils, and waxes, reducing agents, oxidizing agents, UV screening agents, conditioning agents, agents for combating free radicals, sequestering or stabilizing agents, antioxidants, acidifying agents, alkaline agents, volatile or non-volatile silicones, reactive or chemically inert polymers, pigments, solid organic or inorganic particles, vitamins, plant extracts, or propenetrating agents or fibre-swelling agents.

The additional step of applying at least one cosmetic composition, when it takes place, may be preceded or followed by rinsing, by a step of washing the hair fibres, by a step of hair shaping or controlling the shape, for example using a fixing gel, a hair shaping mousse, a lacquer or a leave-in conditioner in cream form, by a step of permanent, semi-permanent or temporary dyeing, by a step of permanent deformation using a reducing agent and optionally a fixative, by a step of alkaline straightening, especially with sodium hydroxide or with guanidine carbonate.

BRIEF DESCRIPTION OF THE FIGURES

The invention may be understood better from reading the following detailed description of nonlimiting exemplary embodiments thereof and from studying the appended drawing, in which.

DETAILED DESCRIPTION OF AN EMBODIMENT OF THE INVENTION

Figure 1:
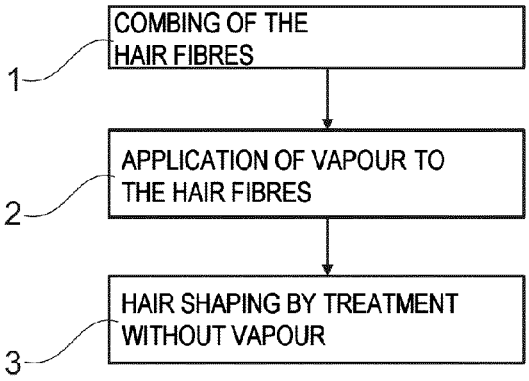
FIG. 1 is a diagram illustrating an exemplary embodiment of the process according to the invention.

In the example illustrated in FIG. 1, the process according to the invention comprises three successive steps 1, 2 and 3 carried out on a lock of hair fibres by an apparatus for treating hair fibres. The apparatus is configured to carry out the various steps of the process successively on the hair fibres, by movement of said apparatus along the lock of hair fibres, especially over a portion of the hair fibres inserted between two arms of the apparatus, forming tongs.

Step 1 is a step of combing hair fibres, making it possible to separate the hair fibres. After this step 1, the lock receives vapour in step 2 in an amount equal to 0.8 g/min in this example. Then, separately from step 2, but immediately thereafter, the hair fibres are subjected to a heat treatment without vapour by conduction and/or radiation in a step 3, with the aim of smoothing them.

Figure 2:
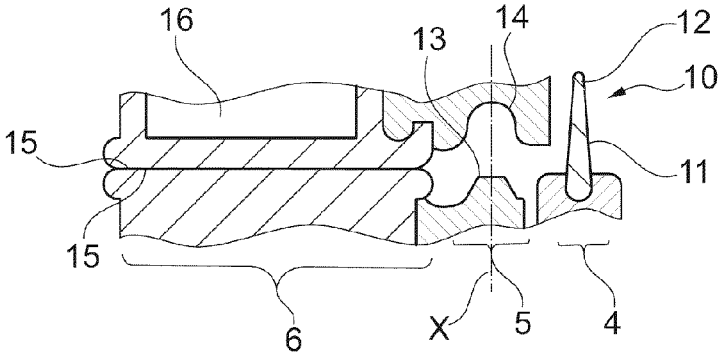
FIG. 2 is a partial schematic depiction in cross section of an example of an apparatus for treating the head of hair that may be used for carrying out the process according to the invention.

For this purpose, an apparatus 10 for treating the head of hair, comprising two arms articulated together so as to form tongs, depicted partially schematically in FIG. 2, may be used.

Step 1 is thus carried out by the comb 11, one tine 12 of which can be seen in this figure, in a combing zone 4.

Step 2 is carried out by a row of vapour outlet nozzles 13, one of which can be seen in FIG. 2, in a vapour application zone 5. This row of nozzles 13 faces, along the axis X, perpendicular to the lock of hair fibres during treatment thereof, a groove 14 that makes it possible to confine the vapour emitted along the axis X by the nozzles 13. The nozzles 13 are borne by one arm of the apparatus, while the groove 14 is defined by the other arm. The lock passes between the row of nozzles 13 and the groove 14. The groove 14 does not have its own heating means.

Finally, in a zone 6 for heat treatment without vapour, step 3 is carried out by passing and grasping the lock between two plates 15 facing one another, each borne by one of the arms of the apparatus 10. At least one resistive heating element 16 makes it possible to heat at least one of the plates 15. The vapour application zone 5 and the zone 6 for heat treatment without vapour are thus separate on the apparatus.

Figure 3:
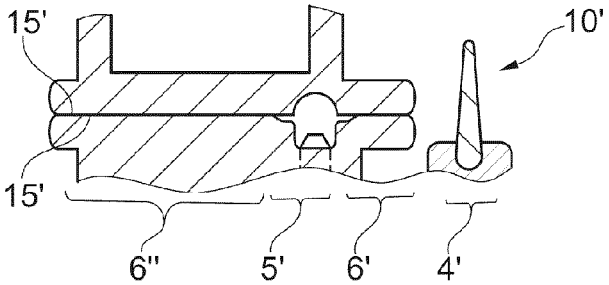
Fig. 3 PRIOR ART
FIG. 3 is a view, similar to that of FIG. 2, illustrating prior art.

The apparatus 10' illustrated in FIG. 3 originates from the prior art, and the vapour application zone 5' is located between two zones 6' and 6" for heat treatment by conduction/radiation, by contact with heated surfaces. Thus, a lock of hair fibres passing into the apparatus 10' is subjected to a step of combing in the combing zone 4', undergoes heat treatment and grasping between the heating plates 15' in zone 6', then undergoes application of vapour in zone 5' and another heat treatment in zone 6".

Comparative Test

The treatment of a lock of hair fibres in accordance with the process according to the invention, for example using an apparatus 10 for treating the head of hair as described above, was compared with that of a lock of hair fibres in accordance with a process of the prior art, for example using an apparatus 10' for treating the head of hair which differs from the apparatus 10 by the fact that steps (ii) and (iii) are carried out simultaneously over the same portion of hair fibres. An untreated control lock was also observed.

Figure 4:
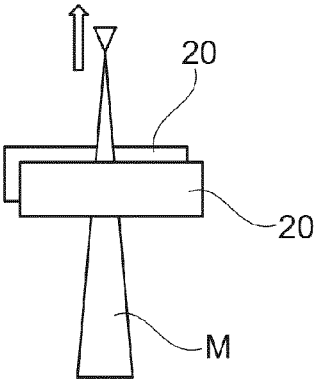
FIG. 4 is a basic diagram of an experiment carried out with an extensometer for the comparison of the treatment of a lock of hair fibres with an apparatus according to FIG. 2 and with an apparatus according to FIG. 3.

In order to carry out the comparison, a Lloyd LS1 type extensometer is used, equipped with a system for clamping the heating plates of smoothing irons in a manner force-controlled by a dynamometer. The basic diagram is given in FIG. 4. The extensometer makes it possible to control the speed of movement of the lock M through the smoothing iron. The extensometer makes it possible to control the pressure, so as to apply identical pressure from the heating plates to the hair fibres during the movement of the lock in the direction of the arrow illustrated in FIG. 4, from one apparatus to another.

Two locks of type 4 curly hair fibres (2.7 g/27 cm) were treated, as indicated above, under the following experimental conditions.

The speed of movement in this example is constant and is fixed at 108 cm/min. The clamping force of the heating plates 20 is controlled at 5N along a straight axis relative to the axis of the lock.

The heating temperature of the plates is 200° C. The vapour flow rate is 0.8 g/min.

A single pass in the apparatus is performed for each lock.

Figure 5:
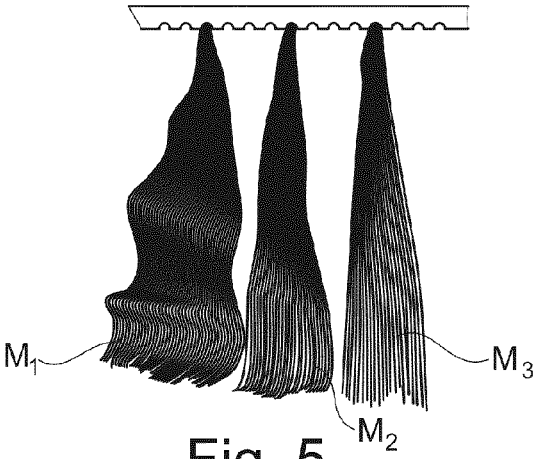
FIG. 5 represents three locks of hair fibres after various treatments described below.

The result obtained for the three locks of hair fibres M1, M2 and M3 is illustrated in FIG. 5.

The lock M1 is an untreated control lock. It is curly.

The lock M2 was treated as in the apparatus 10' illustrated in FIG. 3 under the experimental conditions described above.

The lock M3 was treated as in the apparatus 10 illustrated in FIG. 2 according to the process in accordance with the invention with the same experimental conditions.

Qualitatively, these locks M1, M2 and M3 were classified by a panel of five evaluators on the criterion of manageability (alignment of the fibres relative to one another) in the following decreasing order: M3 superior to M2 greatly superior to M1 (M3>M2>>M1).

Visually, in terms of volume, the locks M1, M2 and M3 were also evaluated on the criterion of volume in the following decreasing order: M3 superior or equal to M2 greatly superior to M1 (M3≥M2>>M1).

With identical clamping of the tool and identical speed of movement of the lock of hair fibres, carrying out the process according to the invention, with a step of combing, a step of vapour application and a step of heat treatment without vapour, especially between two plates, is more effective in terms of visual smoothing (alignment of the fibres and reduction of the volume) from the first pass than carrying out a process outside the invention with a step of combing, a step of heat treatment between two plates, a step of vapour application and a step of heat treatment between two plates.

The invention claimed is:

1. A process for treating hair fibres with an apparatus comprising a first arm and a second arm articulated together so as to form tongs configured to carry out the various steps of the process successively and separately on the hair fibres in a closed configuration of the first and second arms, by movement of said apparatus over a portion of the hair fibres extending between the first arm and the second arm of the apparatus in the closed configuration of the first and second arms, the process comprising:

(i) combing said hair fibres with a comb borne on the second arm, (ii) applying vapour to said hair fibres, wherein a flow rate of vapour applied is less than 1 g/min, and wherein the application of vapour is in a confined space formed by a groove in the first arm facing at least one vapour outlet on the second arm in the closed configuration of the first and second arms, a bottom of the groove being centered on the at least one vapour outlet, the vapour accumulating into the confined space, the comb extending outside the groove, (iii) hair shaping, by heat treatment without vapour, of the hair fibres by grasping the hair fibres between at least two plates facing one another, wherein at least one of the at least two plates is a heating plate, wherein (ii) and (iii) are performed separately over a same zone of the hair fibres, wherein (iii) is performed after (ii) over the same zone of the hair fibres, and wherein said same zone of the hair fibres is not grasped between the plates before and during (ii), and wherein the process does not comprise applying a cosmetic composition to the hair fibres with the apparatus.

2. The process according to claim 1, wherein the flow rate of vapour applied is from 0.7 g/min to 0.9 g/min.

3. The process according to claim 1, wherein the process is carried out in the following order: (i), (ii), then (iii).

4. The process according to claim 1, wherein at least (ii) and (iii) are carried out in a single pass per lock of hair fibres.

5. The process according to claim 1, wherein the heat treatment in (iii) is carried out at a temperature ranging from 90° C. to 230° C.

6. The process according to claim 1, further comprising providing an apparatus for treating the hair comprising the at least two plates, the at least one vapour outlet acting on a zone of the hair fibres other than that included between the at least two plates at a given moment, wherein (ii) and (iii) are carried out within said apparatus for treating the hair.

7. The process according to claim 6, wherein the apparatus for treating the hair further comprises, the groove and, facing said groove, said at least one vapour outlet, wherein said at least one vapour outlet and the groove are offset relative to the plates.

8. The process according to claim 7, wherein, in (ii), the hair fibres are made to pass between said at least one vapour outlet and the groove.

9. The process according to claim 6, wherein the combing in (i) is carried out within the same apparatus, wherein the apparatus comprises a comb, arranged upstream of said vapour outlet.

10. The process according to claim 1, wherein the hair fibres are human hair.

11. The process according to claim 1, wherein the flow rate of vapour applied is from 0.75 g/min to 0.85 g/min.

12. The process according to claim 1, wherein the heat treatment in (iii) is carried out at a temperature ranging from 120° C. to 210° C.

13. The process according to claim 1, wherein the heat treatment in (iii) is carried out at a temperature ranging from 170° C. to 210° C.

14. The process according to claim 1, wherein the groove is symmetrical with respect to a longitudinal plane.

* * * * *